United States Patent [19]

Lin

[11] 4,208,834

[45] Jun. 24, 1980

[54] REMOTE RADIO CONTROLLED INFLATABLE TOYS

[75] Inventor: Pin-Houn Lin, Taipei, Taiwan

[73] Assignee: Mando International Corp., Taipei, Taiwan

[21] Appl. No.: 928,774

[22] Filed: Jul. 27, 1978

[51] Int. Cl.[2] ..... A63H 30/04; A63H 3/06; A63H 3/50

[52] U.S. Cl. ..... 46/254; 46/88; 46/32

[58] Field of Search ..... 46/87, 88, 103, 32, 46/254, 97, 106, 101, 99, 107, 253, 255, 256, 257

[56] References Cited

U.S. PATENT DOCUMENTS

| | | | |
|---|---|---|---|
| 1,439,592 | 12/1922 | Wheeldon | 46/107 |
| 1,610,154 | 12/1926 | Riley et al. | 46/87 |
| 2,027,225 | 1/1936 | Gill | 46/87 |
| 2,622,835 | 12/1952 | Ippolito | 46/32 |
| 2,840,951 | 7/1958 | Green | 46/88 |
| 3,151,866 | 10/1964 | Glass et al. | 46/99 |
| 3,160,983 | 12/1964 | Smith et al. | 46/99 |
| 3,199,249 | 8/1965 | Carver et al. | 46/104 |
| 3,472,333 | 10/1969 | Lowenstern, Jr. | 46/254 |
| 3,512,300 | 5/1970 | Thoresen | 46/103 |
| 3,546,814 | 12/1970 | Melendez | 46/101 |
| 3,643,375 | 2/1972 | Ginsburg et al. | 46/106 |

*Primary Examiner*—Russell R. Kinsey
*Assistant Examiner*—Michael J. Foycik, Jr.
*Attorney, Agent, or Firm*—Burns, Doane, Swecker & Mathis

[57] ABSTRACT

Remote radio controlled inflatable toy includes a huge inflatable figure of man, animal or object, a movable base connected to the bottom of the figure and operable by remote control of a radio signal, and a separately provided radio signal emitter/controller. Wheels radio signal receiver and drive mechanism are provided under the movable base to drive and/or change direction of movement through the remote control of the radio signal emitter/controller. A connector is provided on top of the base to retain the inflated figure and keep the figure from falling from the base. The static figure is removably mounted on the base through inflation to cause its bottom or foot to be urged against the connector or retracted therefrom. The radio controlled base adds a dynamic interest to the static figure mounted thereupon. When the figure is separated from the base, both can be played with as individual items. A plurality of figures can be provided interchangeably on a single base.

11 Claims, 10 Drawing Figures

REMOTE RADIO CONTROLLED INFLATABLE TOYS

FIELD OF INVENTION

The present invention relates generally to remote radio controlled inflatable toys and more particularly to a movable inflatable toy having an inflatable figure of man, animal or object, a base connected to the bottom of the figure and movable by remote controlled radio signal, and a radio signal emitter/controller.

BACKGROUND OF INVENTION

Conventional inflatable toys having a given configuration remain static which is boresome to a player, and the educational effect of a static toy is far less than that of a dynamic one. The static inflatable toy may be turned into a dynamic one through other means; however the modification involves complication and inconvenience. Remote radio controlled toys have so far been quite popular, yet most of them are restricted to the form of vehicles, tanks, ships made with metallic or plastic molded materials and the sizes of such toys are mostly small and without creativity. The present inventor seeks to combine an inflatable figure which can be of a huge size without difficulty with a base connected to its foot or bottom to contain a drive means actuated by remote control of a radio signal. Thus a static inflatable toy is turned into a dynamic one to increase interest of playing and also the educational effect.

SUMMARY OF INVENTION

Therefore, the main object of the present invention is to provide a remote radio controlled inflatable toy, having a huge inflatable figure connected with a base containing a radio signal receiver and drive means. Connection occurs through expansion of the foot or bottom of the figure to fit with a connector provided on the base. A separated radio signal emitter is provided for remote control enabling a static toy to become dynamic.

Another object of the present invention is to provide a radio controlled inflatable toy wherein the connection of the inflatable figure to the movable base is accomplished by expanding the bottom or foot of the figure to the connector on the base. Once the figure is deflated, it is easily dismounted from the base.

Still another object of the present invention is to provide a radio controlled inflatable toy, the inflated figure of which can be of as huge a size as desired, yet its weight is still small enough to be driven by a radio controlled drive means. Deflation of the although huge figure results in a small volume, facilitating packing and transportation.

A further object of the present invention is to provide a radio controlled inflatable toy, of which the figure is single footed yet simultates a pair of feet being connected to a single base.

A still further object of the present invention is to provide a radio controlled inflatable toy wherein the figure has a pair of separated feet with one foot connected to a base having drive means, another foot being provided thereunder with an idles wheel means which is used to stablize the toy and capable of moving with the base.

Another object of the present invention is to provide a radio controlled inflatable toy wherein the individual foot is connected to the base or idles wheel means by way of a fastening means or other feasible means.

Still another object of the present invention is to provide a radio controlled inflatable toy having a plurality of inflatable figures which are exchangeable to incorporate a single base.

Other features and objects will become clear from the following detailed description to be taken in conjunction with the annexed drawings.

DETAILED DESCRIPTION OF PREFERRED EMBODIMENTS

Figure 1:
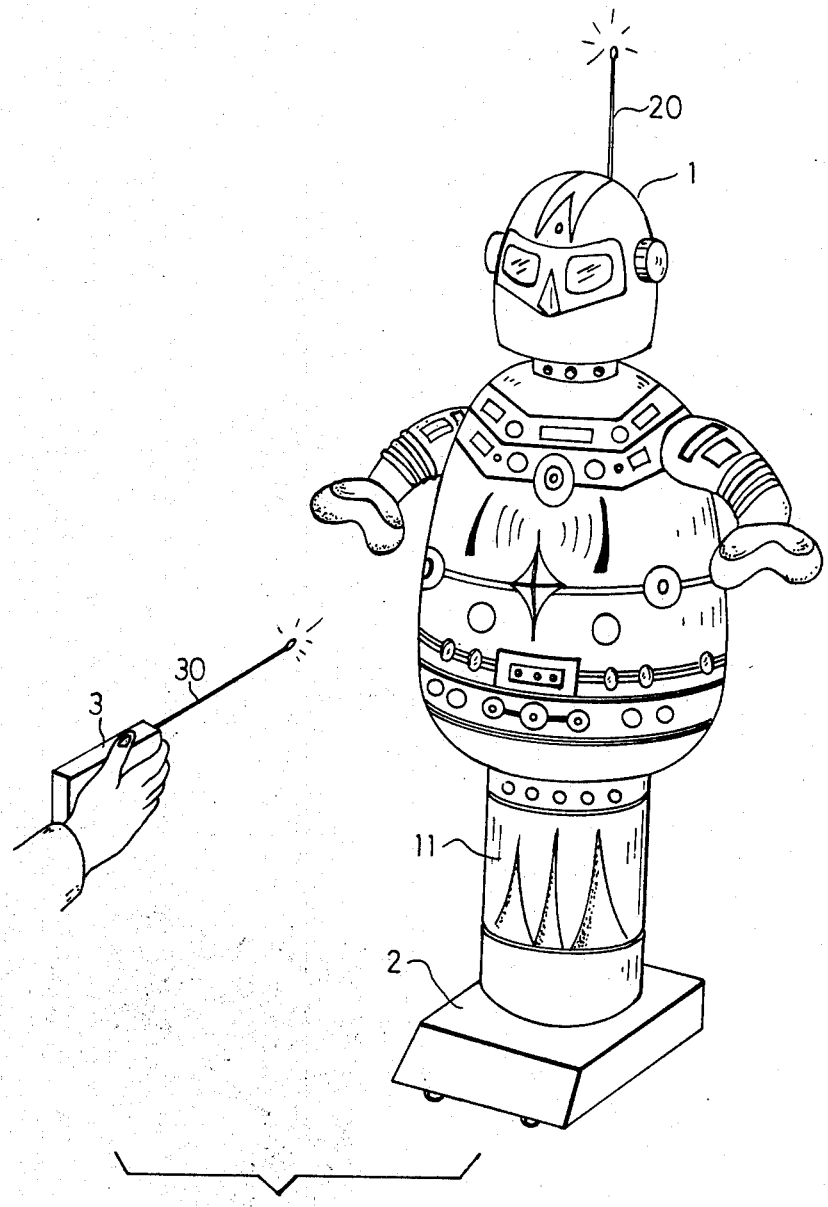
FIG. 1 is a perspective view of a preferred embodiment of the radio controlled inflatable toy according to the present invention.
Figure 2:
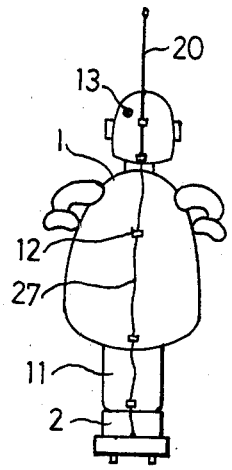
FIG. 2 is a back view of the embodiment in FIG. 1.

Now referring to FIGS. 1 and 2, the remote radio controlled inflatable toy of the present invention comprises a huge inflatable FIG. 1 such as a man, a base 2 dismountably connected to the foot or bottom 11 of the FIG. 1 and movable by the radio signal emitted from the radio signal emitter/controller held in the hand of a player.

Figure 8:
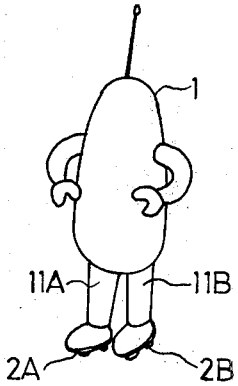
FIG. 8 is a perspective view of an embodiment showing the inflatable figure having a pair of feet.

Said inflatable figure can be of such as a man, an animal or a cartoon animation, a robot or any other object of huge size made of air tight PVC material. The bottom 11 of the FIG. 1 can be made into a single cylindrical form to simplify the construction, yet also can be made into a pair of separated feet such as shown in FIG. 8. The single cylindrical form may be painted or printed to resemble a pair of feet in case the figure is a man. An inflating valve 13 is disposed at any suitable point of the FIG. 1. In the case where receiving antenna 20 is to be installed on top of the FIG. 1, a plurality of antenna fixers 12 made of PVC strips attached to the back of the FIG. 1 by high frequency wave or the like along a route leading fromm the base 2 toward the top of the FIG. 1 shall be required. If the antenna 20 is to be installed directly on the base 2, the fixers 12 are of course not needed.

Figure 3:
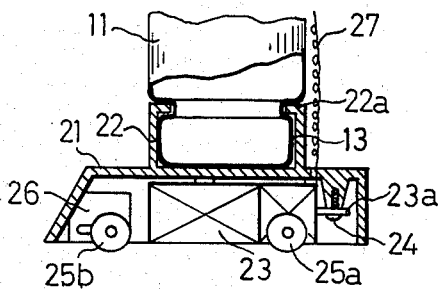
FIG. 3 is a partial cut away side view of an embodiment showing the connection of the foot of the inflatable figure to the base.
Figure 4:
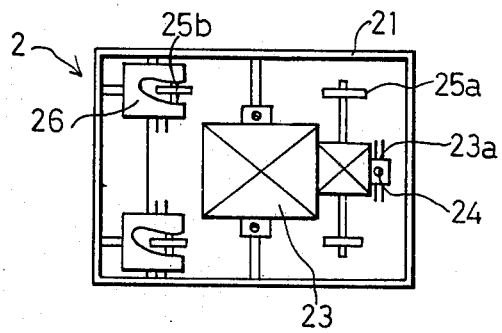
FIG. 4 is a bottom view of the base.

Referring to FIGS. 3 and 4, the base 2 is disposed under the bottom or foot 11 of the FIG. 1, comprising a body 21 and a connector 22 on top of the body 21. A radio signal receiver and drive means 23 such as used in conventional radio controlled toys is installed under the base body 21 by means of a bracket 23*a* and screws 24.

The means 23 comprises a pair of driving wheels 25*a*; and a pair of follower wheels 25*b* are supported by a bearing member 26 disposed at front end under the base body 21. In this embodiment, the bearing member 26 is of such a type that when the wheels 25*b* are driven backward, it changes direction automatically. Other type of bearing members can also be used so far as it is practicable. Connector 22 in this embodiment is a cup-shaped element or cylinder 22 formed integrally with the base body 21. An abutment surface in the form of a laterally inwardly projected flange 22*a* is provided on top of the cylinder 22 for capturing an anchoring means such as a neck-like groove construction 13 around the bottom end of foot 11 of the FIG. 1 which forms a neck of reduced cross-section. When the FIG. 1 is inflated, necklike groove construction 13 is expanded to be caught by the flange 22 so that the FIG. 1 is fixedly connected to the base 2. Dismounting of the FIG. 1 from the base 2 can be easily done through deflation whereby the groove 13 is contracted.

Figure 5:
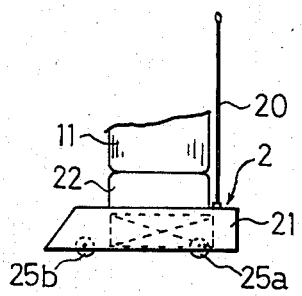
FIG. 5 is a side view of the foot of the figure and the base showing the antenna for receiving radio signal being installed directly on the base.

Leading wire 27 is provided to connect the radio signal receiver and drive means 23 to the antenna 20 disposed on top of the FIG. 1. Antenna 20 can be installed directly on the base 2 such as shown in FIG. 5, so that the leading wire 27 can be omitted and the FIG. 1 and the base 2 can be separated as two individual playing items. The bottom or foot 11 of the FIG. 1 can be printed to simulate a pair of shoes, otherwise the base body 21 can be made with a spacing split to resemble a pair of shoes while the connector 22 retains its cylindrical form.

Figure 6:
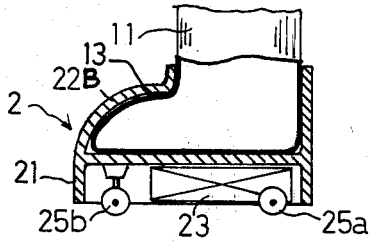
FIG. 6 is a partial cutaway side view of another embodiment showing the connection of the foot of the inflatable figure to the base.

In the embodiment shown in FIG. 6, the base 2 is formed like a pair of shoes, base body 21 being the sole, and cup-shaped connection 22B being the proper of the shoe and defining an abutment surface for retaining the figure. In the meantime, the bottom 11 of the FIG. 1 is formed into foot shape to fit into the shoe-like connector when expanded by inflation.

Figure 7:
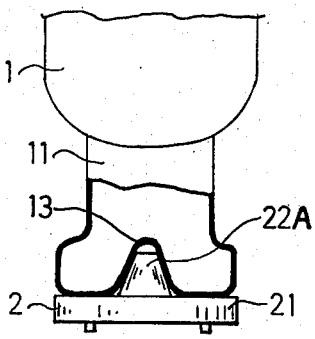
FIG. 7 is a partial cutaway front view of a still another embodiment showing the connection of the foot of the inflatable figure to the base.

FIG. 7 depicts another form of connection, wherein the bottom 11 of the FIG. 1 is in cylindrical form yet with a conical recess 13 provided thereunder. An abutment surface in the form of a conical riser 22A is formed on top of the base body 21 to serve as a connector to be tightly fitted within the recess 13 under the FIG. 1.

In FIG. 8, the bottom of the FIG. 1 is formed into a pair of feet 11A, 11B. One of the feet, say the right foot, can be connected to a base 2A containing receiver and drive means 23 by any means as aforementioned, and the other foot, the left foot, is connected for stabilizing and balance to an auxiliary base 2B with only idler wheels provided thereunder and without receiver/-drive means.

Figure 9:
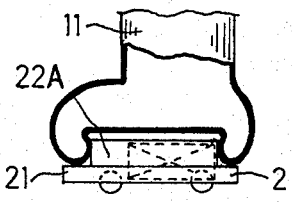
FIG. 9 is a side view of an embodiment showing the connection of one of the feet of the figure to the base.
Figure 10:
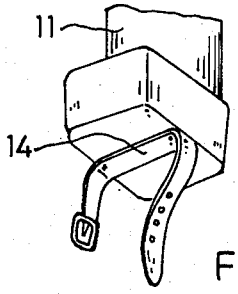
FIG. 10 is a perspective view of a further embodiment showing the connection of one of the feet of the figure to the base with a fastening means.

A further way of connection is shown in FIG. 9, wherein the base 2 of FIG. 7 is modified to fit with another form of recess under the FIG. 1. Fastening means such as shown in FIG. 10, by attaching a fastening belt 14 by high frequency wave to the bottom of the FIG. 1 can also be adopted as a means of connection to fasten the figure onto the base 2 or 2A.

The toy as shown in FIG. 8 can also be modified to have both feet made active by providing both bases 2A and 2B with a signal receiver and drive means so that the two receivers can receive the same signal emitted from a single emitter or different signals from two individual emitters that remotely control the toy.

The figure of the abovementioned inflatable toy can be other than that of a man, viz., any other figures simulating an animal, a vehicle, a plant, etc. Among the ways of connection, the afore-mentioned expansion method seems the most preferable; however, connection by way of a fastening means is practicable yet less convenient than expansion. The toys in question can be operated to move on land, and also can float on water, such as a boat, a fist, etc.

The toy of the present invention with the abovesaid features is capable of being made to a huge sized figure with only a small weight. The expansion connection facilitates easy mounting and dismantling. When assembled, it is a huge size remote controlled toy, and separable into two individual items for playing. After deflation, the packing volume is small, it is convenient for storage and transportation.

The above embodiments are given only for illustration purpose and not by way of limitation, modifications will become evident to those skilled in the art which will fall within the scope of attached claims.

I claim:

1. In a toy of the type comprising a figure mounted on a remote radio controlled mobile base which moves in response to radio signals emitted from a manually actuable signal emitter, the improvement wherein said base includes abutment surface means, said figure being inflatable and includes an inflatable bottom portion which, upon inflation of said figure, is expandible to engage said abutment surface means to retain said figure on said base, said bottom portion being contractible upon deflation of said figure to break said retaining engagement with said abutment surface means.

2. Apparatus according to claim 1, wherein said base includes a cup-shaped connector into which said bottom portion of said figure may be inserted, said abutment surface means comprising a flange extending laterally inwardly from a side of said cup-shaped connector to define a neck of reduced cross-section which confines said bottom portion against removal from said base when the former is in an expanded condition.

3. Apparatus according to claim 2, wherein said bottom portion includes a lateral groove which receives said flange when said figure is in an expanded condition.

4. Apparatus according to claim 2, wherein said cup-shaped connector is cylindrical.

5. Apparatus according to claim 2, wherein said cup-shaped connector is in the form of a person's shoe.

6. Apparatus according to claim 1, wherein said abutment surface comprises an upwardly extending projection of said base, said bottom portion including a recess which tightly engages said abutment surface when said figure is in an inflated condition.

7. In a toy of the type comprising a figure mounted on a remote radio controlled mobile base means which moves in response to radio signals emitted from a manually actuable signal emitter, the immprovement wherein said base means comprises a pair of base portions, at least one of which is operable by remote radio signals, said figure being inflatable and including downwardly depending legs which are individually securable to respective ones of said base portions.

8. Apparatus according to claim 7, wherein one of said base portions contains idler wheels which are incapable of being driven by remote control.

9. Apparatus according to claim 7, wherein both of said base portions are operable by remote radio signals.

10. Apparatus according to claim 9, wherein said base portions are operated by different remote radio signals.

11. In a toy of the type comprising a figure mounted on a remote radio controlled mobile base which moves in response to radio signals emitted from a manually actuable signal emitter, the improvement wherein said figure is inflatable and includes a downwardly depending bottom portion, and a strap on said bottom portion for releasably securing said bottom portion to said base.

* * * * *